United States Patent [19]

Briggs et al.

[11] 4,161,018

[45] Jul. 10, 1979

[54] LIGHTED ORNAMENTAL DEVICES

[76] Inventors: James B. Briggs, 1722 La Barranca, La Canada, Calif. 91011; Flake M. Wakefield, 2852 Burkshire Ave., Los Angeles, Calif. 90064

[21] Appl. No.: 787,289

[22] Filed: Apr. 13, 1977

[51] Int. Cl.[2] ..... F21V 33/00

[52] U.S. Cl. ..... 362/104; 362/800; 362/811

[58] Field of Search ..... 362/103, 104, 105, 106, 362/108, 800, 806, 811, 227, 228, 231; 340/171 R, 171 A, 378 R

[56] References Cited

U.S. PATENT DOCUMENTS

| | | | |
|---|---|---|---|
| 3,737,647 | 6/1973 | Gomi | 362/104 |
| 3,790,720 | 2/1974 | Schartmann | 340/171 R X |
| 3,866,035 | 2/1975 | Richey, Jr. | 362/104 |
| 3,916,253 | 10/1975 | Driscoll | 340/378 R |

*Primary Examiner*—William M. Shoop

*Assistant Examiner*—Peter S. Wong

*Attorney, Agent, or Firm*—Lyon & Lyon

[57] ABSTRACT

There are disclosed herein various forms of ornamental devices such as jewelry and the like, including a plurality of light sources, the light sources being illuminated in a random or substantially random fashion. An exemplary belt buckle is illustrated, including a circle of light sources of two different colors. Several suitable electronic circuits for driving the sources are disclosed, and any one of the circuits can be physically attached to or form an integral part of the ornamental device. Each circuit includes one or more oscillators along with logic elements, such as logic gates and/or registers, for providing electrical signals for turning on and turning off the light sources. Typically, the light sources are light emitting diodes. In one particularly useful form of circuit disclosed herein, the light sources are turned on and off one at a time in a random fashion and the frequency of the on/off cycle varies.

13 Claims, 9 Drawing Figures

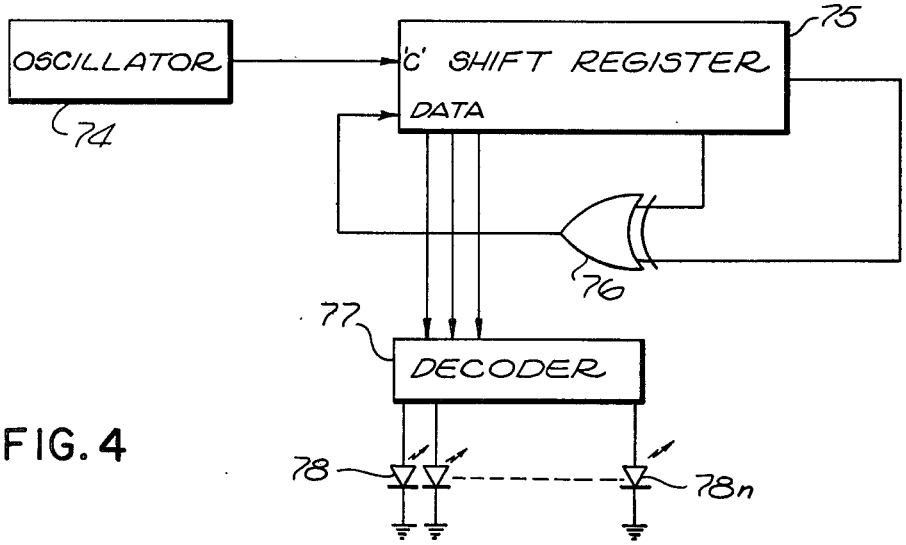
FIG. 4
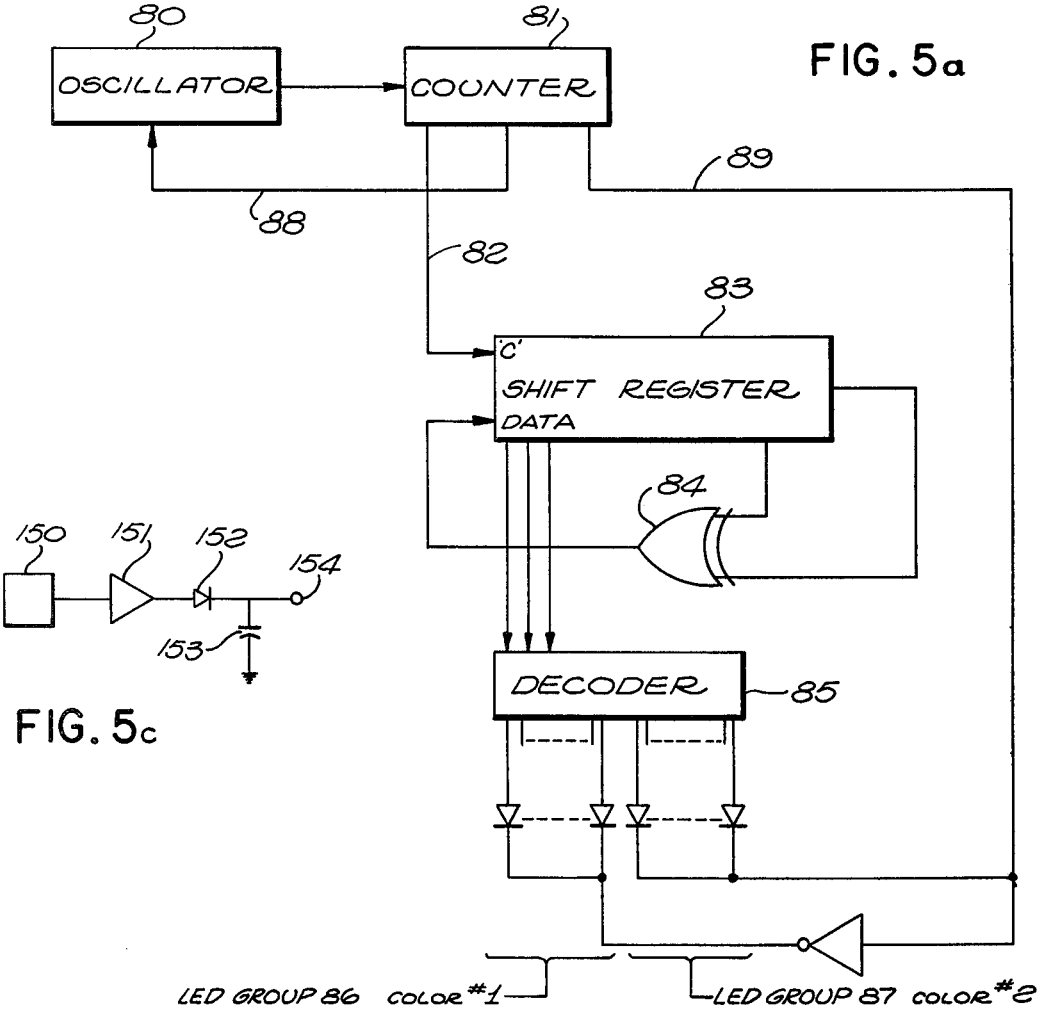
FIG. 5a
FIG. 5c

LIGHTED ORNAMENTAL DEVICES

BACKGROUND OF THE INVENTION

The present invention relates to the creation of visual effects by means of a plurality of light sources having variable illumination levels, such as on and off, and more particularly to ornamental devices, such as jewelry, art objects and similar devices, having a plurality of light sources which are controlled by an associated electronic circuit which provides random or substantially random illumination of the sources.

Various systems and devices have been developed in the past for providing different types of visual effects by means of light sources. Relatively familiar devices are those referred to as "color organs," and these generally include a frequency selective circuit for energizing a plurality of differently colored light sources at various levels of illumination over time and as a function of input frequency range. Such systems generally include several analogue filter circuits, amplifiers and colored light sources, and require an input electrical signal in the audio frequency spectrum. Such devices and systems are relatively large and bulky and are not adaptable for use on or in small objects such as jewelry and the like.

In addition, several approaches have been devised for providing visual effects from jewelry by means of one or more light sources which are turned on and off. For example, U.S. Pat. No. 3,737,647 illustrates costumes having a plurality of light emitting diodes (LED's) and electronic circuits responsive to acoustical or audio frequency stimulation to turn on and off the diodes. This patent also discloses an automatic system using a shift register wherein the light sources can be illuminated in a predetermined order or pattern. U.S. Pat. Nos. 3,986,144, 3,737,731, 3,901,121, 3,866,035, 3,805,047, 3,521,049, and 3,508,041 disclose various ornamental devices using R-C circuits or multivibrators for causing one or more light sources to be illuminated in a pattern. Furthermore, U.S. Pat. Nos. 2,854,563, 3,984,674, 3,549,878, 3,384,740 and 3,383,503 disclose ornamental items containing one or more light sources and employing motion or pressure sensitive devices such as mercury switches, to cause illumination of the light source or sources to be responsive to physical movement.

The foregoing developments have several drawbacks. While "color organs" and like devices can produce random illumination of a plurality of light sources to the extent that the audio input includes random frequencies, they are generally designed for illuminating groups of light sources at variable levels of illumination for each given frequency range and, thus, incorporate a relatively large number of sources to provide large levels of illumination of varying degree and bulky circuits for providing control of the illumination as a function of the received frequencies. Other devices generally include circuits which generate a fixed or relatively fixed pattern of illumination from sources and, thus, tend to present a boring display. While those devices using motion or pressure sensitive switches can generate a random illumination to the extent the motion involved is random, they involve the use of relatively cumbersome mechanical switch structures, such as mercury switches, pressure switches and the like and are not readily susceptible of miniaturization.

On the other hand, the concepts of the present invention enable a relatively compact structure to be constructed as a part of or as an attachment to an ornamental device, and one which provides random or substantially random illumination of the sources at one or more rates.

Accordingly, it is an object of the present invention to provide an improved form of ornamental device.

Another object of this invention is to provide an improved form of ornamental device including an electronic circuit for causing a plurality of light sources to be operated in a random or substantially random and pleasing manner.

An additional object of this invention is to provide an improved electronic circuit which can be compact and require a relatively small amount of energy, while still providing a pleasing random control for light sources.

A further object of this invention is to provide an improved form of circuit for generating random output at different rates.

DESCRIPTION OF DRAWINGS

These and other objects and features of the present invention will become better understood through a consideration of the following description taken with the drawings in which:

FIG. 4 is a block diagram of a form of electronic circuit for generating pseudo-random illumination; and FIGS. 5*a* and 5*b* are, respectively, a block diagram and circuit diagram of an advanced form of the circuit of FIG. 4 for additionally generating a color shift and different rates of illumination, and FIG. 5*c* illustrates a circuit modification for FIG. 5*b*.

DETAILED DESCRIPTION

Figure 1A:
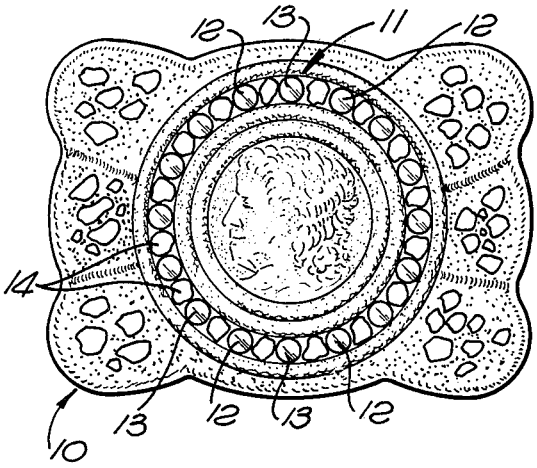
FIGS. 1*a* and 1*b*, respectively, illustrate the front and back of an exemplary ornamental device, in the form of a belt buckle, employing the concepts of the present invention.
Figure 1B:
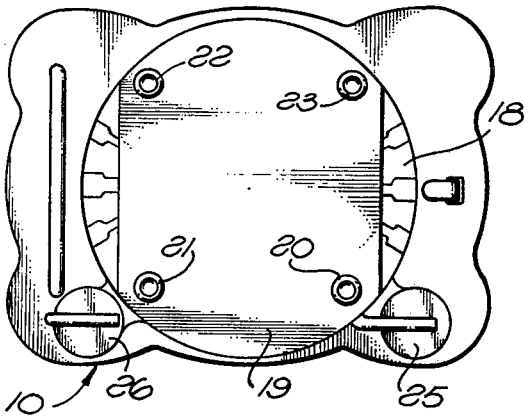

Turning now to the drawings, FIGS. 1*a* and 1*b* illustrate a conventional belt buckle 10 which has been modified to include a plurality of light sources, electronic control circuit, and power source according to the present invention. The belt buckle 10 may be of any suitable form and, in this exemplary embodiment, includes a circle 11 of colored light sources on the front side or face thereof. In an exemplary form, the light sources may comprise a set of yellow LED's 12, a set of red LED's 13, and a set of suitable stones 14 interspersed in the manner illustrated to form a suitable display. It will be appreciated that the concepts of the present invention are applicable to various forms of jewelry items, such as brooches, pendants, rings earings, and so forth, and with the plural light sources arranged in any suitable manner. Thus, the light sources may be disposed other than in a circle, and may be disposed in any suitable form including various shapes, such as hearts and the like.

FIG. 1*b* illustrates the reverse side of the belt buckle 10, and shows an electronic circuit board 18 and insulating cover 19 secured in any suitable manner to the belt buckle, as by screw fasteners 20–23. An electrical power source for the electronic circuit is illustrated in the form of a pair of batteries 25 and 26 which may be mounted in any convenient manner either to the jewelry item or to the electronic circuit itself.

The present invention contemplates any suitable form of ornamental object along with the addition of light sources which reactivated and controlled by an electronic circuit to produce illumination effects which are preferably random or substantially random. Random or substantially random illumination is preferred because it is less boring and has a particular fascination to the observer. The general appearance of the object still is basically that of an ordinary piece of jewelry or the like, typically comprising a silver or gold item with various precious or semi-precious gems. Some or all of the gems are replaced by light sources, either incandescent bulbs or light emitting diodes.

Experimentation has shown that random, substantially random or pseudo-random illumination of individual sources provides a particular fascination for an observer. Generally, one source of light is illuminated at a given instant. The light is thus caused to jump randomly from one location to another by turning on one source and turning off the previous source. Various rates of the on/off cycle have been tried, and rates between one and ten hertz are especially effective. Rates lower than approximately one hertz tend not to hold the eye or attention of the observer, and rates higher than approximately ten hertz cause an effective merging of the illumination and the observer loses interest. Furthermore, it generally is preferable for one source to be turned on as a previous source is turned off, but a suitable duty cycle can be provided (such as fifty percent) to conserve battery energy inasmuch as practically all of the energy consumption is by the light sources. Although the number of lights may be two or more, four or more are preferable, but the actual number depends upon the size of the object. Four sources or more provide more interesting patterns, and four, eight, twelve and sixteen source arrays are readily adaptable for jewelry usage.

The light sources may be of various colors. Red sources are particularly useful for their psychological characteristics and because red is readily generated by LEDs. White is attractive when sufficiently bright, because it relates to the color of the diamond. Mixed colors may be used for other effects, and changing colors on a regular or random basis may be used for effect. As noted above, the sources must flicker at a minimum rate to maintain interest (eg., one hertz). Rates which are too high (eg., above ten hertz) tend to appear distracting or gaudy, or merge as indicated above. A rate which changes from one value to another adds significantly to the visual effect. Modulation of the brightness of the light may be used to add a further dimension of interest. Modulation at a high rate, one which is too high for the eye to follow, also is useful to increase the light production efficiency of LED's.

Turning now to the exemplary circuits, FIGS. **2*a* and 2*b* illustrate a relatively simple circuit for generating simple random illumination. This circuit employs two oscillators 30 and 31, and decoding gates 32 to drive four LEDs 33 through 36. The A and B oscillators 30 and 31 operate at different frequencies, such as five hertz and seven hertz, and provide square wave outputs. Only one LED 33–36 is turned on at any one time, and the illumination of the LED's is apparently random over a short period of time. The closer the frequencies of the oscillators 30 and 31** to each other, the longer the time before the illumination period of the sources repeats. Using one oscillator having three cycles in five seconds and the other having three cycles in seven seconds gives a least common denominator of thirty-five seconds which represents the repeating illumination period.

The outputs of the oscillators 30 and 31 are gated together by the decoding gates 32 to drive the light sources 33–36. The output of the A oscillator 30 is connected to And gates 38 and 39, and through an inverter 40 to And gates 41 and 42. Similarly, the output of the B oscillator 31 is connected directly to the And gates 42 and 39, and through an inverter 43 to the And gates 38 and 41. The outputs of gates 38, 41, 39 and 42 are connected to the respective LED's 33–36, or incandescent lamps if desired. The letters A and B shown in FIG. **2*a* represent the outputs of the A and B oscillators 30 and 31, respectively, with A and B representing a "true" signal or existence of a pulse from the respective oscillator, and $\overline{A}$ and $\overline{B}$ representing the false state or lack of pulse. Thus, the output of And gate 38 will be true when the output of the A oscillator 30 is true and the output of the B oscillator 31 is false, to thereby cause source 33 to be illuminated. The other And gates 39 through 42** function in a similar manner as will be apparent to those skilled in the art.

With the relatively simple circuit of FIG. **2*a*, the illumination from the sources 33–36** appears to be random if the two oscillators are uncorrelated. Because of its simplicity, this circuit is particularly suited for rings, earrings and similar small items.

Figure 2A:
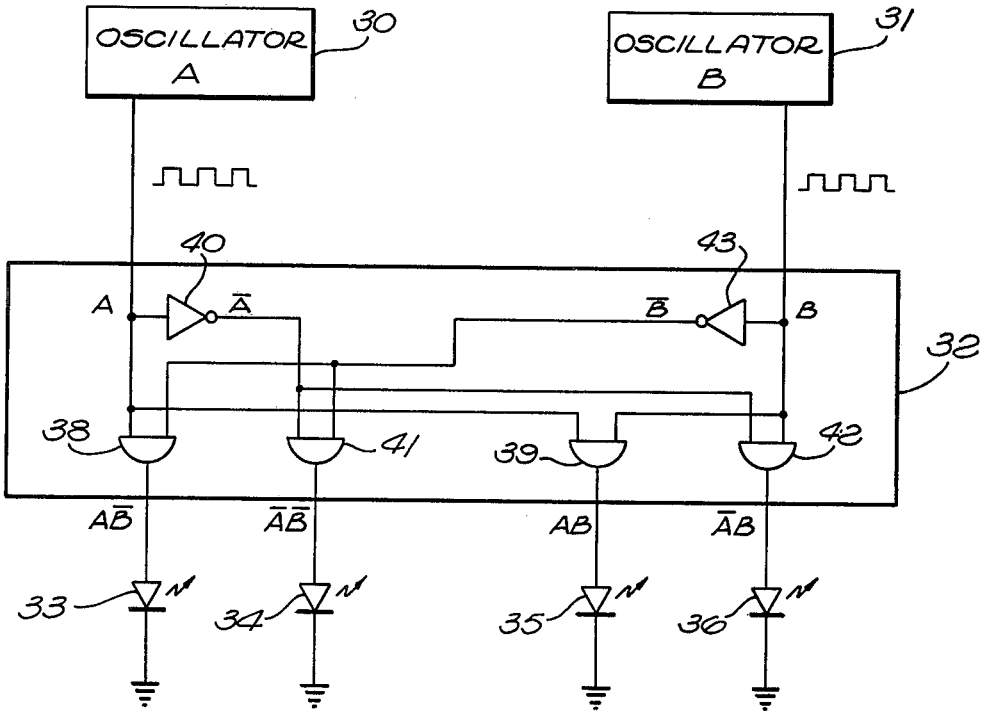
FIGS. 2*a* and 2*b* are, respectively, a block diagram and a detailed circuit diagram of one circuit embodiment according to the present invention for producing simple random illumination.
Figure 2B:
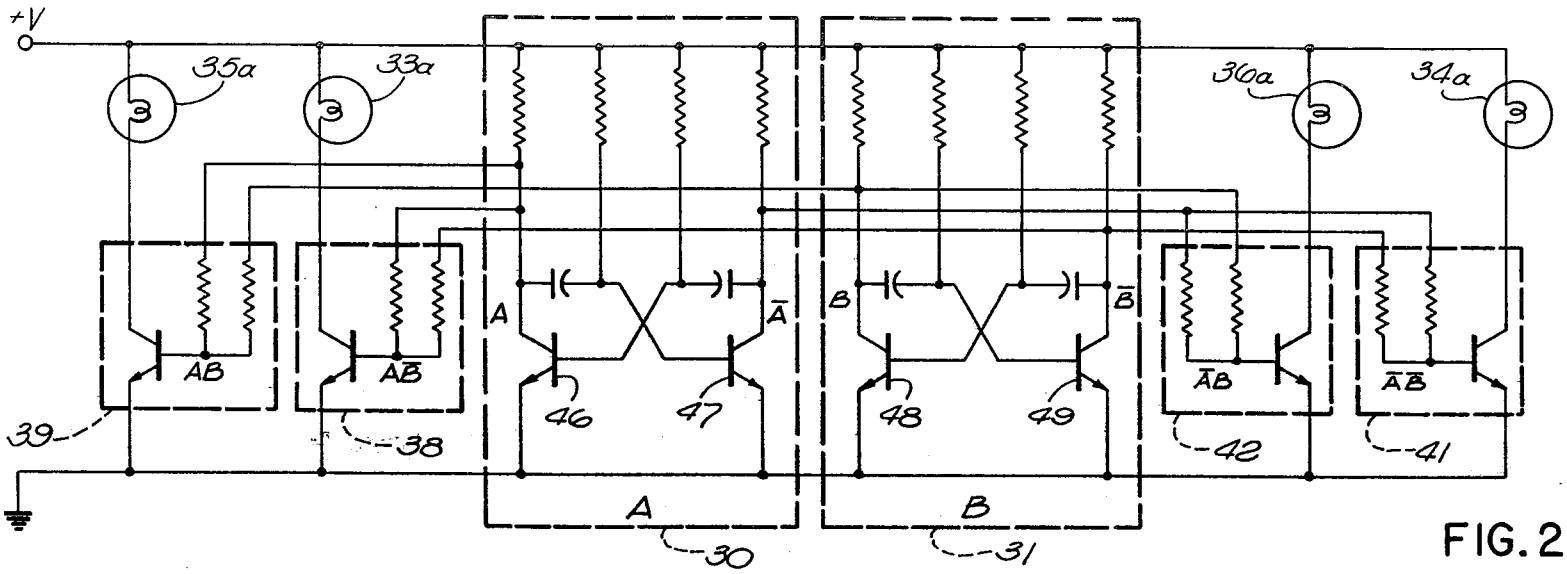

FIG. **2*b* is an actual circuit diagram of the circuit of FIG. 2*a*, but shows incandescent lamps 33*a* through 36*a*. Similar reference numerals are used to designate like components of FIG. 2*a*. The incandescent lamps may be Chicago minature incandescent lamps, such as those used to edge-light liquid crystal watch faces, but LED's can be directly substituted. The oscillator 30 employs a pair of transistors 46 and 47, and the oscillator 31 employs a pair of transistors 48 and 48 in conventional oscillator circuits to generate output square waves at the desired frequencies. Each of the transistors used in the circuit of FIG. 2*b*** may be 2N5089.

Figure 3:
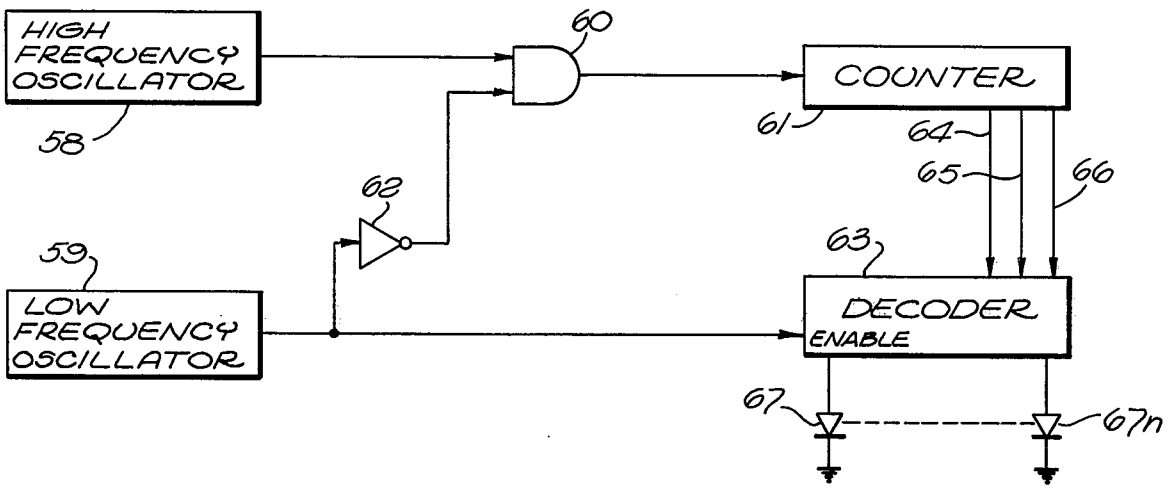
FIG. 3 is a block diagram of another form of electronic circuit for generating complex random illumination.

Turning now to FIG. 3, the same illustrates a system for generating complex random illumination. The system employs two oscillators 58 and 59, one operating at a high frequency, and the other operating at a low frequency to gate the output of the high frequency oscillator. For example, oscillator 58 may operate at approximately two hundred kilohertz, and the oscillator 59 operate at three hertz and have an unsymmetrical rectangular wave pattern. The output of the high frequency oscillator 58 is connected through an And gate 60 to the "count" input of a counter 61. The output of the low frequency oscillator 59 is connected through an inverter 62 to another input of the And gate 60. The output of the oscillator 59 also is connected to the "enable" input of a decoder 63. Three outputs 64 through 66 of three respective stages of the counter 61 are connected to the decoder 63, and the decoder 63 decodes the count on these three lines 64–66 to cause energization of one of a plurality of LED sources **67–67*n***.

When the output of the low frequency oscillator 59 is off or low, this output is inverted by the inverter 62 to enable the And gate 60 which, in turn, passes pulses from the high frequency oscillator 58 to the counter 61. The low output from the oscillator 59 also disables the decoder. Conversely, when the output of the oscillator 59 is high, this high output is inverted to disable the And gate 60. The high output from the oscillator also enables the decoder 63. Typically, the output of the low frequency oscillator 59 is off for 1/10 of a second to allow the counter 61 to run while the oscillator 59 also disables the decoder 63. When the output of the oscillator 59 goes on, the counter 61 is stopped at some random count. The count in the counter 61 is decoded by the decoder 63 to turn on one of the sources 67–67*n*. After some period of time, typically several tenths of a second, the output of the low frequency oscillator 59 again goes low and the cycle is repeated. In order to assure a greater degree of randomness, the high frequency oscillator 58 may comprise a noise generator. The noise generator may be a high gain amplifier which amplifies its own input noise.

The low frequency oscillator 59 controls the rate of flashing and turns off the display by disabling the decoder 63. The high frequency oscillator 58 can operate up in the megahertz range, but a lower frequency is preferable. An oscillator 58 that drifts is preferable. Assuming the output of the oscillator 58 is two hundred kilohertz, in one tenth of a second 20,000 counts are counted by the counter 61 and it is unlikely for the counter to stop on the same number two times in a row.

Turning now to FIG. 4, the same illustrates a system for generating pseudo-random illumination. This system makes use of a pseudonoise sequence generator of the type which has been used for code generation in communications systems, including an oscillator 74, shift register 75 and feedback gate 76. The shift register 75 is driven by the oscillator 74, which typically may have a frequency of three hertz. The output of the shift register and one or more tap points along the shift register (such as the last two stages) are gated together using an Exclusive Or gate. As is known to those skilled in the art, the output of the gate 76 is true if both inputs are different, and is false if both inputs are the same. The resulting sequence from the gate 76 is fed back to the data input of the shift register 75. This sequence in the shift register appears to be random, but actually has a period before it repeats, which period may be a maximum of $2^n-1$ clock periods in length where n is the number of stages in the shift register 75. Thus, a number is stepped through the shift register at a rate determined by the oscillator 74. In a system using a four stage shift register 75, the cycle is repetative in fifteen counts. Using a seven stage shift register and a three hertz oscillator 74, 42 seconds passes for the period of illumination to repeat. Several stages, such as three, of the shift register 75 are decoded by a decoder 77 to illuminate one of the LED's 78–78*n* at a time to produce an apparently random illumination of flashing LED's.

Figure 5B:
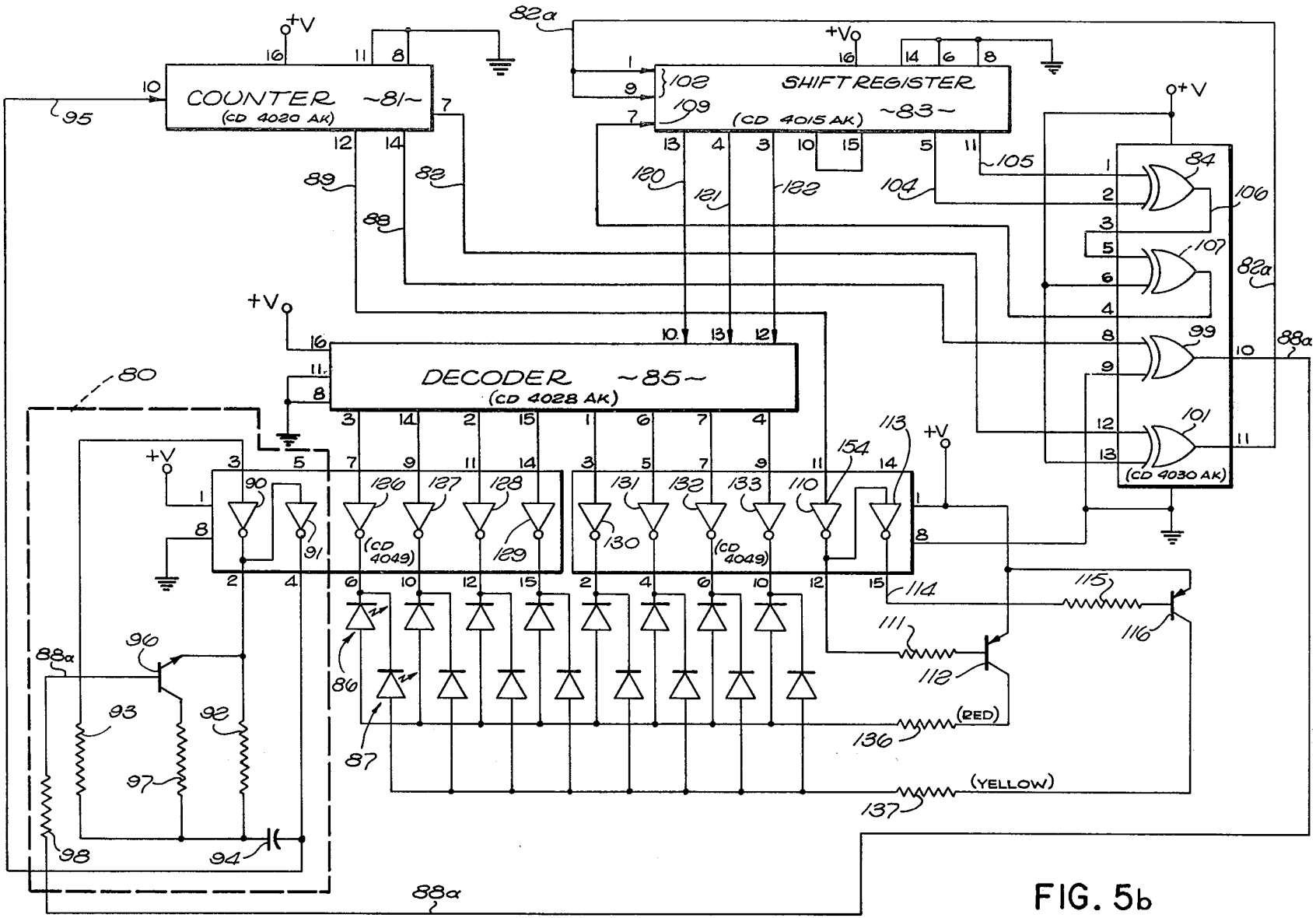

Considering now the system of FIGS. 5*a*–5*b*, the same illustrates an improved form of the system of FIG. 4 and incorporates several additional features. In this system, an oscillator 80 is connected to the count input of a counter 81, and one stage of the counter 81 is connected by line 82 to the clock input of a shift register 83. A feedback gate 84 is connected around the shift register 83 in the same manner the feedback gate 76 is connected around the shift register 75 of FIG. 4. Several stages of the shift register 83 are connected to a decoder 85, the outputs of which are connected to first and second groups of LED's 86 and 87 of different colors.

The oscillator 80 operates at relatively high frequencies, such as one hundred to five hundred hertz and drives the counter 81 operating as a binary frequency divider chain. This arrangement provides, through control of the output of the oscillator, a multiplicity (such as two or more) of related frequencies which may be used to control various additional functions. An output 88 of the counter 81 provides a control signal to the oscillator 80 to change the frequency of the oscillator. Another output 89 of the counter 81 functions to select either the first LED group 86 or the second LED group 87 as will be explained more fully in a discussion of FIG. 5*b*. One of the outputs of the counter also may be used to control brightness of either one or both of the LED groups to provide an amplitude modulation effect In the system of FIG. 5*b*, the LED group 86 may comprise the red LED's 13 of FIG. 1*a*, and the LED group 87 comprise the yellow LED's 12 of FIG. 1*a*. This system produces random illumination of the sources with a color change as, for example: the yellow LED's are illuminated in a random sequence at a first frequency for a given number of clock pulses (which depends upon the tap 88 of the counter 81 used), the red LED's are illuminated randomly at the first frequency for the number of clock pulses, the yellow LED's are illuminated randomly at a second higher frequency (the oscillator 80 is switched to change frequency) for the number of clock pulses, and the red LED's are illuminated randomly at the second frequency for the number of clock pulses, and then this frequency and color change sequence repeats while illumination of the yellow and red LED's continues in a random fashion. The frequency control line 88 from the counter 81 causes the oscillator 80 to change from the first to the second frequency after a given number of oscillator pulses are counted by the counter 81.

As noted above, FIG. 5*b* shows the complete circuit diagram of the system of FIG. 5*a*. Like reference numerals are used in both of the Figures. For the most part, the system of 5*b* can be constructed of integrated circuits with the counter 81 comprising an RCA CD 4020 AK, the shift register comprising a CD 4015 AK and the decoder 85 comprising a CD 4028 AK. In addition, a CD 4030 AK is used to provide several gates (84, 107, 98 and 101), and a pair of CD 4049's are used to provide a portion of the oscillator 80 and to provide drivers for the groups of LED's 86 and 87. A portion of the right-hand CD 4049 provides a pair of inverters (110 and 113) for a color change circuit.

The oscillator 80 comprises an oscillator and a switch for causing the oscillator to change frequency. The oscillator portion of the circuit comprises a pair of inverters 90 and 91, resistors 92 and 93, and a capacitor 94. The output of the oscillator is connected by a line 95 to the input of the counter 81. The switch portion of the oscillator 80 comprises a transistor switch 96, and resistors 97 and 98, and the state of the switch 96 is controlled by the signal on a line 88*a*. The signal on the line 88*a* is derived from output line 88 of the counter 81 (to supply a count thereof) which is connected through an Exclusive Or gate 99 functioning as a buffer. When the switch 96 of the oscillator circuit 80 is on, the resistor 97 is added in parallel to the resistor 92 thereby causing the oscillator to operate at the higher of its two operating frequencies. When the switch 96 is off, the oscillator operates at its lower frequency. The two frequencies typically are approximately one hundred hertz and five hundred hertz. The transistor 96 may be a Motorola MMT 2484, resistor 92 be 820 K, resistor 93 be 1.5 M, resistors 97 and 98 each be 200 K, and capacitor 94 be 0.01 uf.

The counter 81 countsth output of the oscillator circuit as applied by input line 95 to the counter, and the counter provides output pulses on line 82 through an inverter 101 and a line 82*a* to clock inputs 102 of the shift register 83. The shift register 83 is an eight stage shift register, of which seven stages are used in the embodiment of FIG. 5*b*. Outputs 104 and 105 from the first and seventh stages of the shift register are connected to an Exclusive Or gate 84. The output 106 of this gate is connected to a second Exclusive Or gate 107, which merely functions as an inverter to provide an output signal on a line 108 to the data input 109 of the shift register 83.

Output line 89 of the counter 81 is connected through an inverter 110 and a resistor 111 to the base of a transistor 112 to control selection of the first group 86 of LED's (such as red LED's). The output of the inverter 110 also is connected through a second inverter 113, line 114 and resistor 115 to the base of a second transistor 116 which functions to select the second group 87 of LED's (such as the yellow LED's). These transistors each may be a Motorola MMT 2907. This selection function will be described in greater detail subsequently.

The decoder 85 is an eight stage binary decoder which selects one line of eight output lines as a function of the signals on three inputs. Any three suitable stages of the shift register 83 (such as stages two through four) are connected by lines 120 through 122 as inputs to the decoder 85. The outputs of the decoder 85 are connected through inverters 126 through 133 to the groups of LED's 86 and 87. The collector of the first selector transistor 112 is connected through a resistor 136 to the anodes of the first group of LED's 86. Similarly, the collector of the second transistor 116 is connected through a resistor 137 to the anodes of the second group of LED's 87. The resistors 136–137 may each be one hundred ohms, and the resistors 111 and 115 may each be two thousand ohms.

In addition to the features of the circuits of FIGS. 2 through 4, the circuit of FIG. 5*b* provides, (a) change in the frequency of the random illumination of the LED's (they are illuminated randomly at a first frequency, then are illuminated randomly at another frequency, then at the first frequency, and so forth as determined by the frequency of the oscillator 80), and (b) an automatic shift from random sequencing of one color LED's to another color LED's (one color LED's are randomly illuminated, then another color LED's are randomly illuminated, and so forth). Furthermore, and as will be explained later, a brightness change in the illumination of either group of the LED's can also be accomplished in a relatively simple manner.

Considering now the operation of the circuit of FIG. 5*b*, and assuming the oscillator transistor switch 96 to be off, the oscillator 80 provides a low frequency output such as one hundred hertz. The output pulses from the oscillator 80 are counted by the counter 81, and output pulses from the counter are applied through line 82, inverter 101, and line 82*a* to the clock input 102 of the shift register 83. Signals from two stages of the shift register 83 are applied by lines 104 and 105 to the Exclusive Or gate 84, the output of which is inverted by the inverter 107 and applied by line 108 to the data input 109 of the shift register. The foregoing operation is the same as that described with respect to FIGS. 4 and 5*a*. Similarly, output signals from the shift register 83 are applied by lines 120 through 122 to the decoder 85, which decodes these signals and illuminates one LED of either LED group 86 or 87, as was the case with the circuits of FIGS. 4 and 5*a*. The group of LEDs 86 or 87 selected depends upon the state of the transistors 112 and 116. The states of these transistors are complimentary (one is off when the other is on) as controlled by the inverters 110 and 113 and the signal on line 89 from the counter 81.

Assuming the signal on the base of the transistor 112 to be low, this transistor then is on and the LED group 86 (eg., red) is selected. At this time, the signal on the base of the transistor 116 will be high and this transistor will be off, and none of the lower LED group 87 (eg., yellow) will be caused to turn on by the decoder 85. When the signal on the base of the transistor 112 is high, this transistor is turned off and none of the LED group 86 will be turned on by signals from the decoder 85. When the transistor 112 is off, the transistor 116 is on, thereby selecting the LED group 87 to thereby enable a signal from the decoder 85 to illuminate one of this group 87.

The values of the resistors 111 and 115 connected to the bases of the transistors 112 and 116 determine the brightness level of the illuminated LED of group 86 or group 87. A capacitor may be connected to ground from the base of either transistor 112, 116 or both to cause a gradual turn on/turn off. Furthermore, resistors of several values may be connected to the base of either or both of the transistors 112 and 116, along with inverters similar to 110 and 113 and lines (like 89) from different stages of the counter 81 to thereby provide different current levels to the respectively selected LED group as a function of the count in the counter 81. This arrangement enables different brightness levels for several LED groups to be accomplished.

The switch 96 in the oscillator 80 is periodically turned on and off, as a function of the count in the counter 81 at output line 88, to change the output frequency of the oscillator 80 from the low frequency to a higher frequency, (such as five hundred hertz). More than two output frequencies can be provided by using additional switches like 96 and different value shunting resistances, to thereby provide several different random rates of illumination of the group of LED's selected at any instant. Furthermore, another output of the counter 81 may be connected to a "disable" input of the decoder 85 to cause all LED's not to be illuminated for a period of time to thereby provide a further visual impression and to conserve battery energy.

Instead of using the output of the counter 81, via line 89, to cause the color change of the LED's through selection of the first group 86 and the second group 87 periodically, the color change can be effected by audio level changes through the use of the circuit shown in FIG. 5*c*. This circuit includes a microphone 150, audio amplifier 151, and a rectifier/filter comprised of a diode 152 and capacitor 153. The output terminal 154 of this circuit is connected to the like-numbered terminal at the input of inverter 110 (in place of the connection by line 89 from counter 81) of FIG. 5*b*. Audio level changes sensed by the microphone 150 then will cause the color change from one group of LED's to another. In addition, the audio level can function to vary the brightness of the groups of LED's in an alternating fashion. As a further modification, the resistors 136 and 137 may both be connected to the collector of transistor 112 (with inverter 113 and transistor 116 not used) to cause both groups of LED's to vary in brightness and synchronism with music, voice or other sounds detected by the microphone 150.

While embodiments and applications of this invention have been shown and described, it will be apparent to those skilled in the art that modifications are possible without departing from the inventive concepts herein.

What is claimed is:

1. An ornamental device having a plurality of light sources illuminated in a random or substantially random fashion, the improvement comprising plural light sources disposed in a pattern on the face of the device, and circuit means mounted on the device forming a self-contained ornamental/circuit assembly for automatically controlling energization of the light sources one at a time by internal electrical generation of energizing signals, said circuit means comprising oscillator means and means connecting the oscillator means with logic means, said logic means comprising shift register means having feedback from a plurality of stages thereof to its data input through Exclusive Or means for generating said energizing signals in a random or substantially random manner, and having a plurality of outputs connected to decoding means, said oscillator means being connected to another input of said shift register means and said sources being connected to said logic means.

2. A device as in claim 1 wherein the frequency of said oscillator means is several hertz.

3. A device as in claim 1 further including counting means connected between said oscillator means and said another input of said shift register means.

4. A device as in claim 3 wherein said light sources comprise plural groups of light sources, and means are connected from said counting means to enable one or the other of said plural groups of light sources.

5. A device as in claim 3 wherein said oscillator means selectively operates at a plurality of frequencies, and means are connected from said counting means to said oscillator means to control the output frequency of said oscillator means.

6. A device as in claim 4 wherein said oscillator means selectively operates at a plurality of frequencies, and means are connected from said counting means to said oscillator means to control the output frequency of said oscillator means.

7. A device as in claim 6 wherein the groups of light sources emit light of different colors.

8. An ornamental device having a plurality of light sources illuminated in a random or substantially random fashion, comprising plural light sources disposed in a pattern on the face of the device, first and second oscillator means having different output frequencies, counter and decoder means for counting signals from one of said oscillator means and providing output signals to said sources for energizing said sources in a random or substantially random manner, and logic circuit means connected with the outputs of the oscillator means and with the counter and decoding means for causing the output of one oscillator means to gate signals from the other of said oscillator means to said counting and decoding means.

9. A device as in claim 8 wherein the frequency of the first oscillator means is in the kilohertz range and the frequency of the second oscillator means is within the range of several hertz.

10. An ornamental device having plural groups of light sources wherein sources are illuminated in a random or substantially random fashion comprising plural groups of light sources disposed in a pattern on the face of the device, oscillator means for providing output signals, counting means connected with the oscillator means for counting the output signals of the oscillator means, said counting means having a plurality of stages with outputs, shift register means connected with the output of a stage of said counting means for receiving signals therefrom and for generating output signals in a random or substantially random manner, said shift register means having a plurality of outputs, decoding means connected with outputs of said shift register means, said decoding means being connected to said plural groups of light sources, and means connecting an output of a stage of said counting means to said plural groups of light sources for selectively enabling the respective groups of light sources.

11. A device as in claim 10 wherein said oscillator means selectively operates at a plurality of frequencies, and means connecting the output of a stage of said counting means to said oscillator means for controlling the output frequency of said oscillator means.

12. An ornamental device having plural groups of light sources wherein sources are illuminated in a random or substantially random fashion comprising plural groups of light sources disposed in a pattern on the face of the device, oscillator means for providing output signals, counting means connected with the oscillator means for counting the output signals of the oscillator means, said counting means having a plurality of stages with outputs, shift register means connected with the output of a stage of said counting means for receiving signals therefrom and for generating output signals in a random or substantially random manner, said shift register means having a plurality of outputs, decoding means connected with outputs of said shift register means, said decoding means being connected to said plural groups of light sources, and audio circuit means connected to said plural groups of light sources for selectively controlling the groups of light sources.

13. A device as in claim 12 wherein said oscillator means selectively operates at a plurality of frequencies, and means connecting the output of a stage of said counting means to said oscillator means for controlling the output frequency of said oscillator means.

* * * * *